United States Patent [19]

Lancelot, III et al.

[11] 4,124,962

[45] Nov. 14, 1978

[54] JOIST HANGER

[75] Inventors: Harry B. Lancelot, III; Robert M. MacRobbie, both of Fort Worth, Tex.

[73] Assignee: Brown Company, Pasadena, Calif.

[21] Appl. No.: 816,002

[22] Filed: Jul. 15, 1977

[51] Int. Cl.[2] ..... E04B 1/38

[52] U.S. Cl. ..... 52/702; 403/232.1

[58] Field of Search ..... 52/702, 708, 289, 632; 403/232, 230, 187; 248/214, 215, 300; 182/87; 249/23, 211

[56] References Cited

U.S. PATENT DOCUMENTS

| | | | |
|---|---|---|---|
| 2,176,450 | 10/1939 | Barnett | 52/708 |
| 3,468,574 | 9/1969 | Schell | 403/230 |

FOREIGN PATENT DOCUMENTS

| | | | |
|---|---|---|---|
| 186,835 | 11/1955 | Austria | 52/632 |
| 807,551 | 7/1951 | Fed. Rep. of Germany | 52/632 |
| 1,095,251 | 12/1954 | France | 52/702 |
| 595,281 | 6/1959 | Italy | 52/632 |
| 525,474 | 8/1940 | United Kingdom | 52/632 |
| 678,979 | 9/1952 | United Kingdom | 52/632 |
| 729,650 | 5/1955 | United Kingdom | 52/632 |

*Primary Examiner*—Price C. Faw, Jr.
*Assistant Examiner*—Henry Raduazo
*Attorney, Agent, or Firm*—Smyth, Pavitt, Siegemund, Jones & Martella

[57] ABSTRACT

A joist hanger has a shroud with a rear wall and side walls with aligned openings for receiving the legs of a U-shaped pin. A jack screw, straddled by the legs, or a simple support plate rests on the pin to support a joist end. An L angle piece is welded or hinged to the rear wall. The level of the joist can be changed by the jack screw, and/or by turning a threaded hinge bolt, permitting the shroud to ride up or down on the bolt.

25 Claims, 16 Drawing Figures

JOIST HANGER

BACKGROUND OF THE INVENTION

The present invention relates to a supporting device, particularly to a position and elevation adjustable joist hanger or bracket.

Joist hangers are provided usually in pairs, in that they are individually dependent from beams, and a joist is held in position between the beams by the two hangers. For this, each hanger is constructed as a shroud with an angle piece at the rear wall of the shroud, for suspending it from the beam. Adjustable support means are provided in between side walls of the shroud for adjusting the level of the joist. The known constructions, however, do not permit in all respects a satisfactorily simple operation as far as placement of the joist positioning device in the shroud is concerned. Particularly, a release of a joist from the known brackets is often a cumbersome procedure. It may be desirable to just drop the joist out of the hanger without requiring extensive manipulation. Other types of hangers in use are shown, for example, in U.S. Pat. Nos. 2,985,937, and 3,782,676. These hangers, however, do not use shrouds and are of a more complicated construction. Moreover, they do not permit receiving a joist without requiring a bore to be drilled through the joist end.

DESCRIPTION OF THE INVENTION

It is an object of the present invention to provide a new and improved joist hanger in which the joist positioning device permits improved and facilitated release for purposes of releasing the joist.

It is a particular object of the present invention to provide a new and improved joist hanging and positioning device or bracket which exhibits improved characteristics and features as far as assembling and disassembling is concerned so that in particular a hung joist can be released without requiring lifting.

In accordance with the preferred embodiment of the present invention, it is specifically suggested to improve a joist hanger which is constructed from a shroud having a U-shaped cross section with parallel side walls and a rear wall and an L angle piece connected to the rear wall by means of which the joist hanger is dependent from a beam or the like. The specific features permitting easily releasable suspension of a joist in the shroud are provided by a combination of the following elements. The rear wall of the shroud is to have a rectangular slot and in approximate alignment therewith are the upper portions of two pairs of bores in the sidewalls which receive the two legs of a U-shaped release pin so that a supporting platform is defined by the two legs of the pin. A screw jack being comprised basically of a rectangular plate having a central, threaded bore traversed by a threaded bolt, is positioned in that the plate rests on the release pin while the plate is inserted in the aperture securing the plate against tilting about fulcrum parts on the pin legs, and the threaded bolt is disposed between the legs of the U pin, thereby holding the plate against lateral shift as well as against tilting on any of the ledges of the opening. The threaded bolt of the jack screw carries a support plate being journaled on the end of the bolts or supporting a joist upon being received by the shroud.

In accordance with a further feature of the present invention, it is suggested to provide the long leg of the L angle piece with a pair of spaced apart lugs, and a threaded bolt is journaled in these lugs. The rear wall of the shroud is provided with fastener nuts like extensions, threadedly receiving the bolt for being hinged to the angle piece in that manner; turning of the bolt which permits raising and lowering of the shroud, in addition to or in lieu of the level adjustment by means of the jack screw. The jack screw assembly may be replaced by a simple, displaceable support plate which rests on the release pin and a joist to be hung rests on that support plate. In this case, level adjustment is carried out just by turning the hinge bolt. Also, an opening in the rear wall of the shroud for receiving the support plate may not be needed.

In accordance with a further feature of the invention, a pair of stand-off plates being joined by a bottom to define and establish a cradle can be affixed to the side walls of the shroud. The cradle receives a piece of wood being suitably cut to serve as a spacer to establish particularly the vertical position of the joist hanger, if the part such as a flange or the like from which the hanger is dependent, is not sufficiently thick to insure a vertical position of the hanger.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
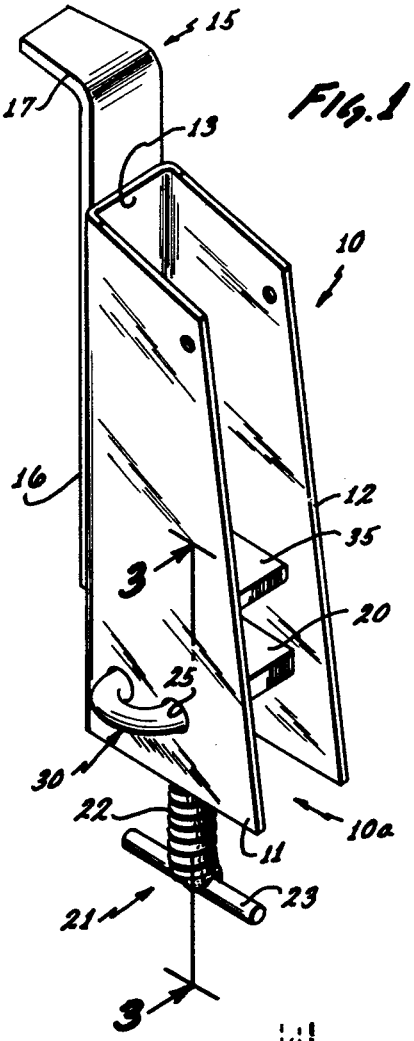
FIG. 1 is a perspective view from one side, from the front and from above of a joist hanger constructed in accordance with the preferred embodiment of the invention.
Figure 2:
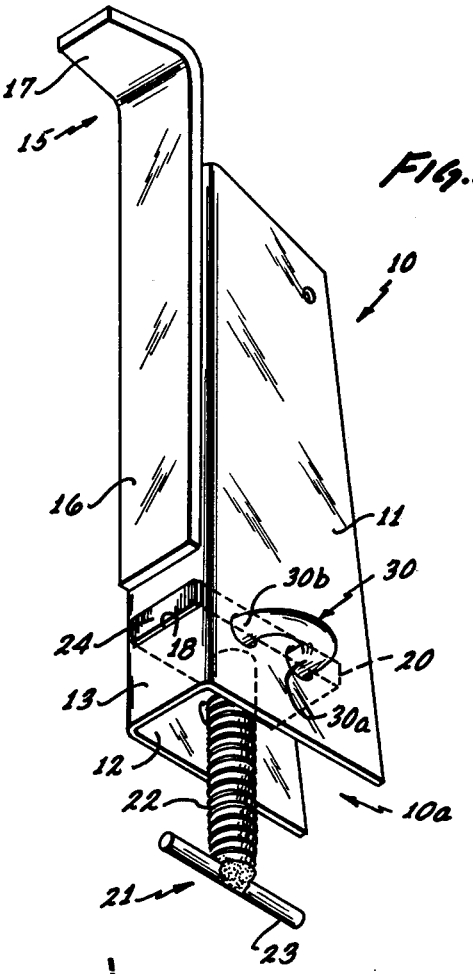
FIG. 2 is a perspective view of the same hanger, but now from below, the same side but the rear, as compared with FIG. 1.
Figure 3:
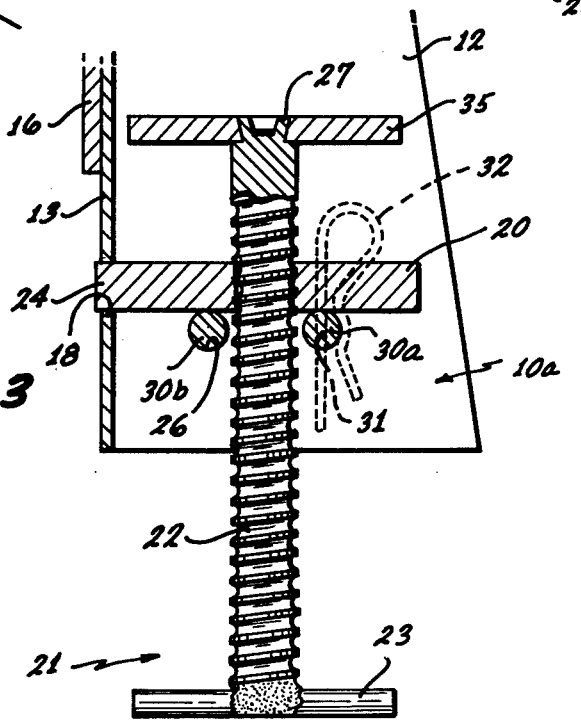
FIG. 3 is a cross section taken at lines 3—3 in FIG. 1.

Proceeding now to the detailed description of the drawing, the figures show a joist hanger which is comprised of the following basic elements: a shroud 10 is constructed from two parallel sidewalls 11 and 12 joined by a rear wall 13. In cross section, the shroud has a U-shaped profile whereby the legs of the U are longer nearer the bottom 10*a* of the shroud as compared with the profile at the top.

A support angle 15 having a long leg 16 and a short, tapered leg 17 is welded to the rear wall 13 of the shroud, particularly by pressure welding the long leg 16 to the outside surface of rear wall 13 and in such a manner that the short leg 17 has a somewhat elevated position as compared with the top of the shroud. The joist hanger will be depended from a cross bar on beam A (FIG. 4) or from other supporting structures such as a concrete wall, by means of the tapered leg 17.

The space in the shroud, i.e. between the side walls 11, 12 is sufficiently wide to receive a joist, for example, from above; and without further measures no obstruction is present so that, in fact, the joist can be removed through the bottom portion 10*a* of the shroud. In order to position a joist within the shroud, the following provisions are made:

First of all, the rear wall 13 of the shroud 10 has a longitudinal, rectangular opening 18 located somewhat above the bottom plane or portion 10*a* of the shroud. This particular opening may receive one small end of a first rectangular plate 20 having a threaded opening or bore in its center. This threaded bore receives a threaded bolt 22 being the adjustable element of a jack screw type assembly 21 and having at its end a welded-on, adjusting handle 23 for ease of turning the bolt 22 in the threaded bore of plate 20.

This plate 20 can be inserted in between the sidewalls 11 and 12; the short dimension of rectangular plate 20 is just slightly shorter than the width of the space between the side walls 11, 12. Also, the dimensions of the opening 18 have been chosen, so that the plate 20 can be inserted in the slot 18. It is important to realize that such a positioning of the plate 20 within the shroud, as well as its removal, requires exclusively a horizontal displacement; lifting is not required. Also, once the plate 20 has been removed laterally from an inserted position in opening 18, the entire jack screw assembly 21 can be dropped and removed through the bottom 10*a* of the shroud. Of course, it is apparent also that placing the front end 24 of plate 20 into the opening 18 is per se not sufficient to position the plate 20 within the shroud. Accordingly, the following additional provisions are made.

The wall 11 has a pair of openings 25 and the shroud wall 12 has a pair of openings 26. The openings of these pairs are, in turn, aligned in that one bore or opening of the pair 25 is aligned with one bore or opening of the pair 26 and the respective two other bores of the two pairs are aligned accordingly. These bores are adapted to receive a U-shaped support and release pin 30. The alignment of the bores, as stated, is particularly chosen so that the release pin upon having its legs 30*a* and 30*b* inserted into the respectively aligned bores assumes a horizontal position.

Near the end of one or both of the legs 30*a, b* of the release pin, an opening such as 31 is provided for receiving a hitch clip 32 which prevents in a simple manner unwanted and accidental removal of the release pin 30 from the apertures 25, 26.

The bores 25 and 26 have, in addition, a very specific position. The top portions of the several bores 25 and 26 are horizontally aligned with each other but in a slightly higher level than the lower ledge of the opening 18. Thus, one can speak of an approximate horizontal alignment of the opening 18 and of the top portions of the several bores 25 and 26. The plate 20 may be placed in between the side walls 11 and 12, and as soon as pin 30 is inserted, plate 20 rests on the two legs 30*a* and 30*b* of the pin. The plate 20 may be shifted deeper into the shroud so that front end 24 projects into opening 18 but plate 20 clears the opening. Plate end 24 when inserted may project slightly out of opening 18, beyond the rear surface of back wall 13, whenever bolt 22 has a position so that the two legs 30*a* and 30*b* of the release pin 30 straddle the bolt. Conversely, when the pin 30 is inserted, plate 20 cannot be slid out of opening 18, because bolt 22 is held between the two legs 30*a* and 30*b*. Moreover, the plate 20 seated on the pin means 30 is also held against pivoting as follows:

Tilting of plate 20 in clockwise direction about a fulcrum point on leg 30*a* of pin 30 is impeded by abutment of plate 20 against the upper ledge of window 18. Tilting in counter-clockwise direction about a fulcrum point on leg 30*b* is impeded by abutment of plate 20 adjacent the lower ledge of window 18. Pivoting about a fulcrum on the lower ledge of opening 18 is impeded by abutment of bolt 22 against leg 30*b* and, finally, pivoting of plate 20 about a fulcrum on the upper ledge of opening 18 is impeded by the legs 30*a* and 30*b* because plate 20 rests on them. Therefore, once plate 20 has been inserted and the release pin 30 placed in position, plate 20 cannot be removed in any fashion without first removing the release pin. There is, of course, some play provided in between the two legs of pin 30 and bolt 22 but that play is smaller than the length of end portion 24 of plate 20 as inserted in the window 18 so that even if the plate 20 is slightly displaced back and forth in the direction of insertion, the end 24 of the plate 20 will still remain in the opening 18.

Figure 4:
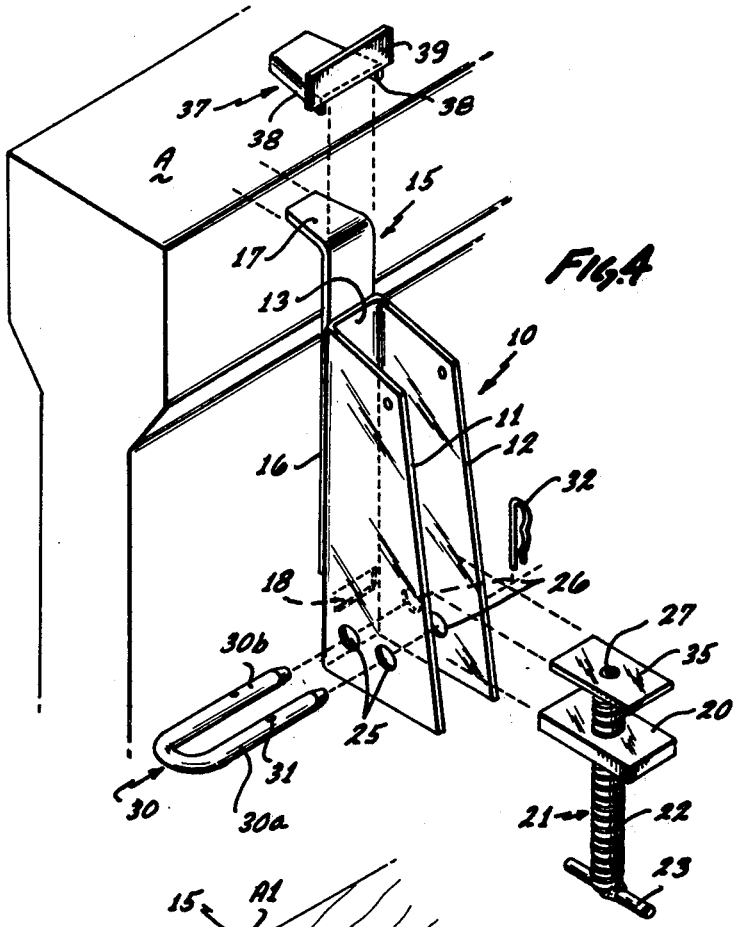
FIG. 4 is an exploded view of a joist hanger.

The top end of the bolt 22 has been cut to provide a pin like portion 27 and a shoulder between the pin and the main shank portion of the bolt. A second plate 35 has an unthreaded bore into which the pin has been stuck but with clearance. Upon staking the pin end one obtains a flared bevel like journal. Plate 35 is rotatable upon the pin and is seated on the shoulder between the pin and the threaded bolt shank. Plate 35 serves as support plate or platform for the joist. The FIG. 4 shows in addition a cover shield 37 having downwardly extending flanges 38 and a bent up shield plate 39. Shield 37 is slipped onto the tapered leg 17. The purpose of the shield is to cover any opening that may exist in the structure above the beam A on account of the positioning of the hanger. If the joist hanger is used in conjunction with a concrete form, the shield 37 prevents concrete from pouring onto the hanger and into the shroud.

The joist hanger will be assembled by a sequence of steps most easily derivable from FIG. 4. The jack screw assembly with the plates 20 and 35 is placed between the side walls of the shroud and plate 20 is inserted into opening 18. The plate 35 will serve actually as a stop so that the bolt 22 has approximately the right position between the aligned bores of the pairs 25, 26. Next, the pin 30 is pushed all the way until opening 31 projects beyond wall 12, whereupon clip 32 is inserted. It will be appreciated that the shroud structure is symetrical; therefore, pin 30 can be inserted from the other side wall as well.

The plate 20 as positioned within the shroud 10 is held by operation of the opening 18 as well as the release pin, and the bolt 22 can be turned manually by means of the adjusting handle 23 whereby the bolt 22 is threaded up or down in plate 20 and support plate 35 is lowered and raised accordingly.

Please note that plate 20 cannot be pushed up whenever the operator turns bolt 22 and exerts also an upward thrust upon the bolt, but plate 20 is held by opening 18, and upward tilting of plate 20 about the upper ledge of opening 18 is additionally impeded upon abutment of plate 35 against rear wall 13. The joist when inserted in the shroud will rest firmly and securely upon that plate 35, in any position or level thereof in the shroud.

The bolt 22 was originally a straight rod and the threading has resulted from helical cold rolling. This way a thread-like groove was worked into the material, and the helical ridge has resulted from radial outward flow of the material. The threading in the bolt, therefore, is established by a smooth, rolled, groove, and the counter threading in plate 20 has primarily its ridge co-operating with the groove of bolt 22. The ridge portion of bolt 22 is, therefore, not very sensitive with regard to small deformations which may result from engagement or abutment of the bolt against the pin legs 30*a, b*.

Figure 5:
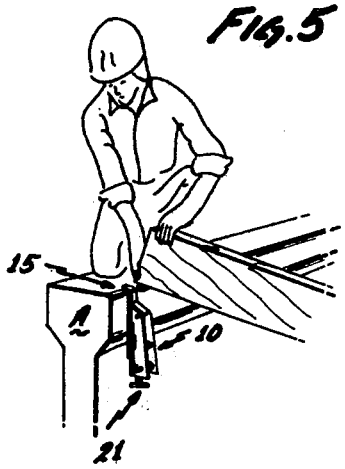
FIGS. 5, 6, and 7 show a joist hanging operation.
Figure 6:
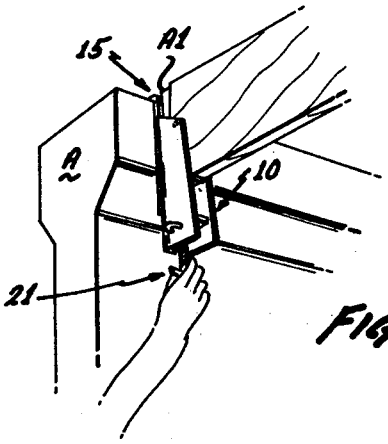
Figure 7:
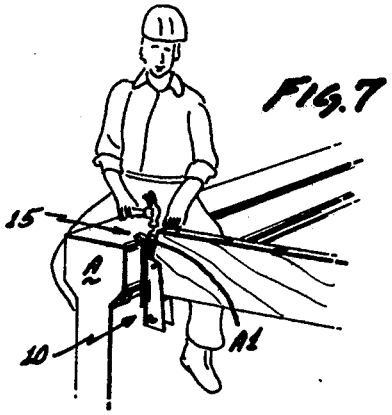

In operation, the joist hanger is used as follows (FIGS. 5, 6 and 7): At first the joist hanger is hung in position on a cross beam, such as A. Next, the joist is placed in between the shroud whereby, for example, the joist shown in FIG. 5 has a tapered end, and the short edge of the joist will be in an up position. The taper may have resulted from cutting a triangular edge A1 from the joist. Next, the joist is adjusted to proper elevation by operation of the screw jack (FIG. 6). The wedge A1 is placed between the tapered top part of the joist A and the rear wall 13 of the hanger, and is driven in between the joist and wall 13 (see FIG. 7).

Figure 8:
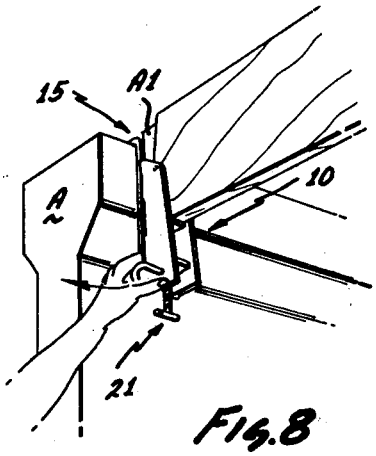
FIGS. 8 and 9 show a joist release operation.
Figure 9:
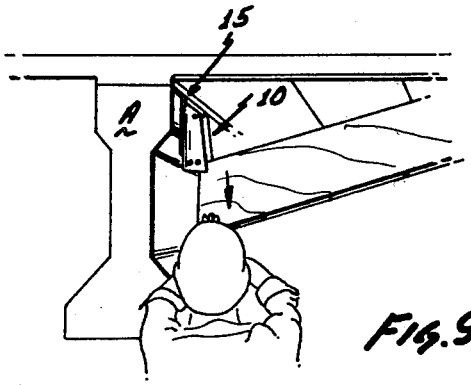

If for any reason removal is desired, the adjusting handle of the hanger is loosened whereby one will rely for temporary support primarily by the wedging action of the previously inserted wedge A1. This removes to some extent the load of the joist upon the release pin, and the release pin 30 can now be removed rather easily (FIG. 8), whereupon the entire jack screw is just slid down without requiring any lifting. Any lifting would have to take place against the wedge A1. The joist can be expected to stay in position until tapped to loosen the wedging action, and now the lower end of the joist will come out of the bottom 10*a* of the shroud (FIG. 9).

Figure 10:
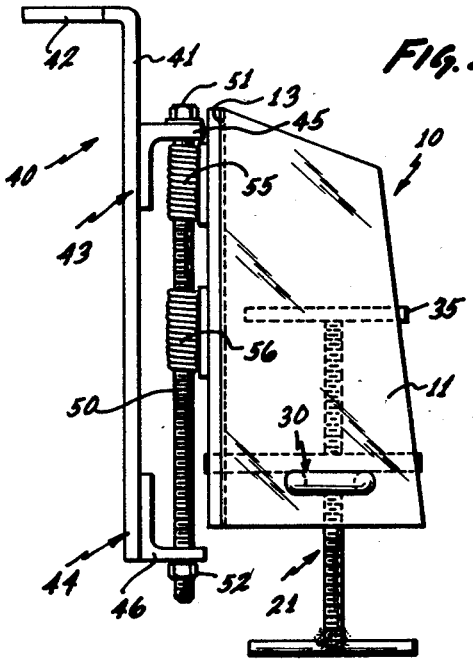
FIG. 10 is a side view of a hinged joist hanger in accordance with the preferred embodiment.
Figure 11:
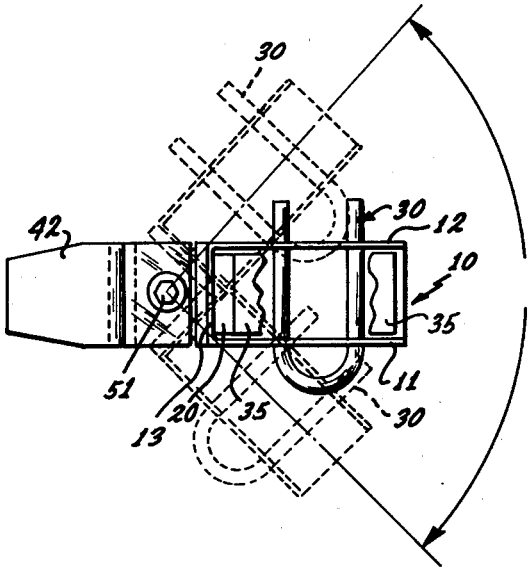
FIG. 11 is a top view of the hanger shown in FIG. 10.
Figure 12:
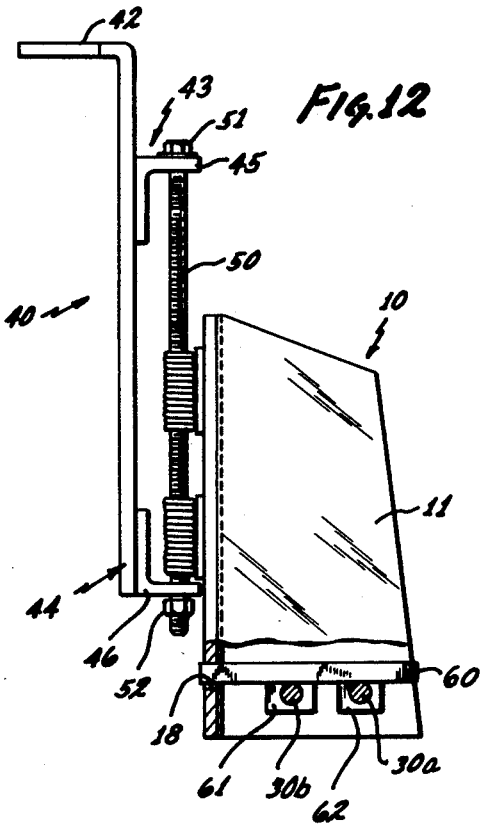
FIG. 12 is a side view of the hanger shown in FIG. 10, but with a modified joist support structure.
Figure 13:
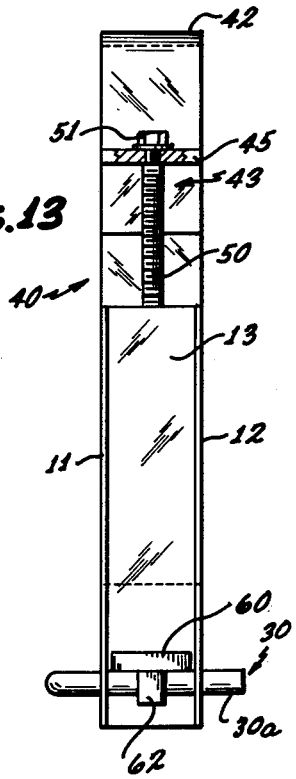
FIG. 13 is a front view of the hanger shown in FIG. 12.

Proceeding now to the description of FIGS. 10, 11, and 12, the joist hanger which is shown here, is also comprised of a shroud 10 having the two parallel side walls 11 and 12 joined by the rear wall 13. The jack screw assembly 21 is likewise provided for positioning an inserted joist and for adjusting its level. However, the level adjustment as provided here is a second stage adjustment. The first stage adjustment results from a combination of shroud hinging and leveling to be described next.

The joist hanger has also an angle piece, support angle or L-shaped element 40, having a long leg 41 and a short, tapered leg 42. This L-shaped element 40 will also be hung from a beam from which the joist hanger is to be dependent, just as angle piece 15 (FIG. 1) is hung as afore described. However, long leg 41 is not welded to the shroud wall 13 but is hinged thereto. Accordingly, long leg 41 of support angle 40 has two lug elements 43 and 44 which are in effect small L-shaped pieces having one flat portion fastened to the leg 41, while the short portions of each of these elements 43 and 44 establish two lugs proper, 45 and 46. Each of these two lugs 45 and 46 has an unthreaded bore or opening, and these two openings are aligned in vertical direction. These openings receive the near-end portions of a bolt 50.

The bolt 50 is a cold-worked, i.e. cold rolled bar for establishing a helical contour thread. The upper end of the bar 50 is kept by a bolt head 51 being actually welded or otherwise affixed to that end of the bolt. Bolt 50 is received in the openings of the two lugs 45 and 46 to permit free turning. A nut 52 is threaded on the other end of the bolt 50, simply to retain the bolt through the two lugs. Actually, bolt 50 is suspended on lug 43 by the bolt head of 51.

The shroud 10 is hinged to the bolt 50 in the following manner: Two coil-like configurations 55 and 56 are welded to the rear wall 30 of shroud 10. The helical loops of the coils establish internally threading-like ridges and grooves. The helices of these coils 55 and 56 are chosen so that they match the threading of the bolt 50. Upon turning of the bolt, these coils 55 and 56 ride up or down carrying the shroud with them. Coils 55 and 56 can be deemed nut fasteners in the general sense, and as such they are hinge elements.

It can be seen further that, due to hinging, the shroud can be pivoted over a rather wide angular range being about 90° (FIG. 11). If the bolt is not held during hinging it will pivot with the shroud. Thus any elevational change will not take place on account of the pivoting. On the other hand if the bolt is held when the shroud is pivoted, the shroud will undergo a slight up or down movement upon being turned as stated, but that displacement is only a fraction of the helical threading and pitch length. On the other hand, upon turning of the bolt 50 the shroud 10 is lowered and raised. Therefore, any up and down displacement of the shroud persuant to hinging can readily be compensated by turning the bolt 50 over the same angle and in the same direction.

A joist can be received with its end between the side walls of the shroud. The joist will rest on the support plate 35 as shown in FIG. 10 and in the manner described earlier. The level of the joist can now be adjusted in a two-fold manner. The joist together with shroud 10 can be lowered or lifted by turning the bolt 50 using a suitable wrench, a key or the like which fits over the bolt head 51. This way one will be able to turn the bolt 50, whereupon shroud 10 rides up or down depending upon the direction of turning. In addition, the jack screw 21 can be operated for changing the position level of the joist within the shroud.

The level adjustment as afore described covers a wide range, whereby the adjustment range of the jack screw assembly is added as a secondary range onto the primary range of shroud displacement resulting from turning of the bolt 50. That primary range is essentially given by the spacing of the lower end of coil 56 from lug 46 while the upper edge of coil 55 abuts lug 45.

FIG. 12 shows how the joist hanger can be employed without the jack screw assembly. One will rely only on the height adjustment of the shroud by means of the bolt-coils combination 50 – 55, 56 for purposes of adjusting the level of the joist. Accordingly, FIG. 12 shows a load bearing plate 60 being placed upon the release pin 30 which has been inserted in a manner as described. The plate 60 resembles, for example, the plate 20 mentioned earlier and particularly the end of that plate may be inserted into the opening 18 in the rear wall of the shroud. However, that particular plate 60 does not have to have a central opening because it is not used as a bearing element for a jack screw. The joist is just placed on top of plate 60.

The load bearing plate 60 is, in addition, provided with two bearing pieces or key elements 61 and 62 having openings or bores which are suitably spaced so that respectively the two legs 30*a* and 30*b* of the release pin can be inserted. This way, bearing plate 60 is positively positioned between the side walls of the shroud and constitutes a releasable bottom or support plate for the joist. One such key element 61 or 62 may suffice, but the double lock is advisible; also, one may not need to insert the plate 20 into an opening 18 for purposes of avoiding tilting. In other words, the rear wall 13 does not have to have an opening 18 in this instance.

Figure 14:
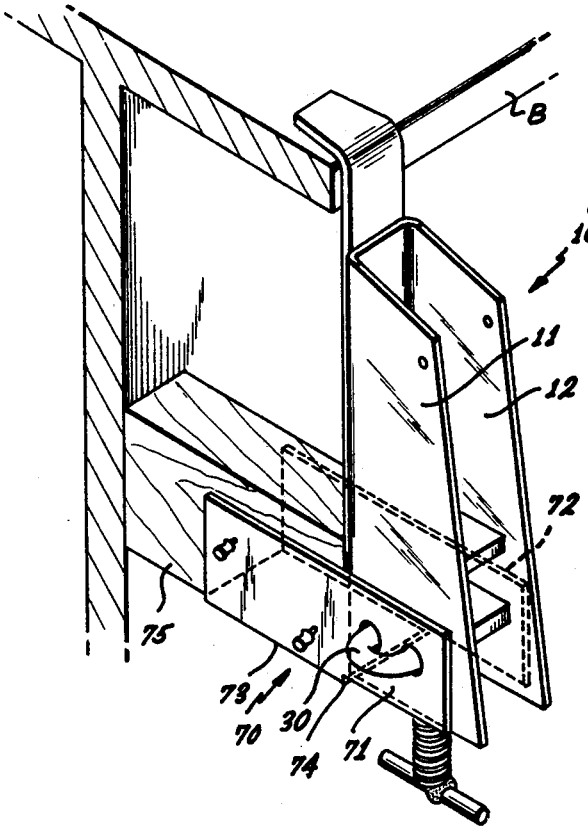
FIGS. 14 and 15 and 16 are perspective views of joist hangers with a different stand-off device affixed thereto.
Figure 15:
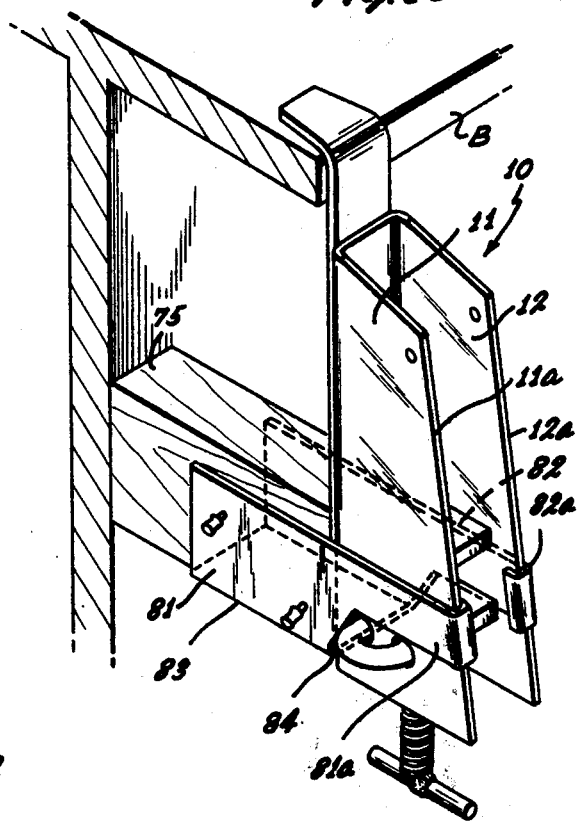
Figure 16:
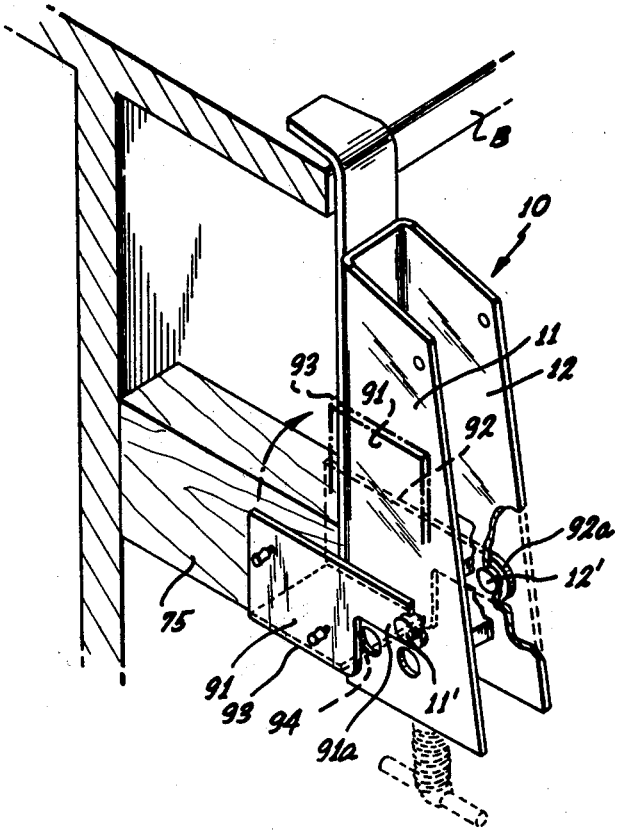

The hitch clip 32 is used in the same manner, for locking the release pin. Removal of the load bearing plate is quite simple, one merely takes out the hitch clip and removes the release pin whereupon plate 60 will fall out and the joist can be removed in the manner described. Decisive is that plate 60 does not have to lifted under load. If the opening 18 is in fact provided in wall 13, plate 60 may rest on the lower ledge and one may use one pin only. FIGS. 14, 15, and 16 show several stand-off devices which can be used in any of the hangers as described before. Their primary function is to level the position of the hanger in the vertical if, for example, the hanger is dependent from a rather narrow flange of an I beam such as B. FIG. 14 shows specifically a joist hanger with a shroud 10, a jackscrew assembly and the L angle member as afore described. Now in addition, the figure shows a stand-off structure 70 which is comprised of a pair of stand-off plates 71, 72 and a bottom plate 73 which, however, does not join the lower edges of the plates 71 and 72 entirely. In fact, the edge 74 of the bottom will rest against the rear wall 13 of the shroud while portions of the plates 71, 72 extend respectively along the side walls 11 and 12 of the shroud.

Each of the plates 71 and 72 has two bores which register with the bores 25 and 26 in the sidewalls of the shroud so that, as illustrated in FIG. 14, the pin 30 can also penetrate these bores. This way the stand-off support 70 will be affixed to the shroud.

The bottom 73 together with portions of the sidewall 71 and 72 form a cradle in which is received a suitably cut piece of wood or beam stud 75. The sidewalls 71 and 72 have small openings so that wooden beam stud 75 can be nailed to the stand-off support 70. The stud 75 is preferrably inserted in the cradle so that its rear end abutts the rear wall 13 of the shroud. In addition, the length of the stud 75 is cut so that the front end can abutt, for example, the web part of the I beam B as shown in FIG. 14. If the joist hanger is of the hinged type as shown in FIGS. 10 through 13, stud 75 has its front end cut at an oblique angle to ensure surface to surface abutment with the web.

FIG. 15 shows a modified stand-off support 80. Again there are provided two sidewalls 81 and 82 joined by a bottom 83 to establish a cradle. The plates 81 and 82 have rearwardly extending arms 81*a* and 82 which are curled back to form hooks. The device 80 will be slipped onto and over the shroud, from above, until the edge 84 of the bottom 83 abutts against the rear wall 13 of the shroud whereupon the hook portions are prevented from sliding down further on the oblique front edges 11*a* and 12*a* of the sidewalls 11, 12 of the shroud. The wooden stud 75 is inserted in the cradle and held by means of nails just as is shown in FIG. 14.

FIG. 16 shows a stand-off support 90 which has again sidewalls 91 and 92 and rearwardly extending arms 91*a*, 92*a* having openings which are aligned in the width dimension of the assembly. The particular stand-off support has also a bottom 93. Sidewalls 91, 92 and bottom plate 93 define a cradle for receiving a wooden stud as a principal stand-off member just as described. The particular arms 91*a* and 92*a* are hinged to the sidewalls of the shroud in that dowel pins 11, 12 and welded both sidewalls of the shroud to be received by the openings respectively in arms 91*a*, 92*a*. Alternatively, the pins could be welded to arms 91*a*, 92*a* and openings receiving such hinge pins could be provided in the walls 11 and 12. The stand-off support is thus snapped onto the shroud. As can be seen from the figure, the stand-off support can be folded up for transport or the like but will be folded down to the position as illustrated in FIG. 16, whereby the rear edge 94 of the bottom 93 rests against the lower portion of the rear wall 13 of the shroud.

The invention is not limited to the embodiments described above but all changes and modifications thereof not constituting departures from the spirit and scope of the invention are intended to be included.

We claim:

1. A joist hanger for being depended from a beam, having a shroud being comprised of an integral structure of a rear wall and two parallel side walls, and further having an L-shaped angle element connected to the rear wall of the shroud and adapted for depending the hanger from the beam, the improvement comprising in combination:

a rectangular opening in the rear wall;

two bores in each of said side walls and being aligned in pairs, and having their respective upper portion in approximate horizontal alignment with the lower horizontal ledge of said opening of said rear wall;

a jack screw assembly, including a plate with a centrally positioned threaded bore and having a threaded bolt threadily received by the bore;

a release pin means having two parallel but spaced apart legs for insertion into said bores in said sidewalls to establish a horizontal support plane in between the sidewalls of said shroud and for positioning said plate upon the two legs of the pin means as an end of said plate is inserted into said opening while the threaded bolt traverses the space in between the two legs of the release pin means; and a support plate for positioning a joist in the shroud at one end of the jack screw bolt, said support plate being journaled on said bolt for being held without rotation in the shroud upon turning the jack screw.

2. A joist hanger as in claim 1, said release pin means being a U-shaped pin.

3. A joist hanger as in claim 1, said threaded bolt being a helically cold rolled pin.

4. A joist hanger as in claim 1, at least one of said legs of the pin means having a bore near its end, the combination further including a clip inserted in the bore to prevent accidental pull-out of the pin means.

5. A joist hanger as in claim 1, said plate of the jack screw assembly being laterally insertible in the slot and being flat so that neither lifting nor tilting is required for inserting.

6. A joist hanger as in claim 1, further including a pair of side wall plates connected to the side walls of the shroud and extending rearwardly therefrom and without obstructing any drop-out of said jack screw assembly; and a stand-off member inserted in-between the side wall plates and affixed thereto, the member having one end abutting the rear wall of the shroud, while abutting said beam with an end opposite side one end.

7. A joist hanger as in claim 6, said side wall plates being joined by a bottom in which the member rests in cradle-like fashion.

8. A joist hanger as in claim 6, said side wall plates having arm-like portions of lesser height where extending adjacent to the side walls of the shroud to clear said bores in the side walls of the shroud, said arm-like portions being connected to the side walls of the shroud.

9. A joist hanger as in claim 8, said arms being hooked to inclined edges of the side walls of the shroud.

10. A joist hanger as in claim 8, said arms being hinged by means of pins to the side walls of the shroud.

11. A joist hanger as in claim 6, said side wall elements each have two bores to be aligned with the bores of a respective adjacent one of the side walls of the shroud so that said pin means connect the side wall plates to the shroud.

12. A joist hanger as in claim 1, the pin means having a bore at one of its end, there being a clip inserted in the bore to prevent accidental pull-out of the pin means.

13. A joist hanger for being dependent from a beam having a shroud, the shroud being comprised of an integral structure of a rear wall and of two parallel side walls, extending from the rear wall but having no integral bottom to permit dropout of the beams from a position between the side walls, the hanger further having an L-shaped angle element connected to the rear wall of the shroud and adapted for depending the hanger from the beam, the improvement comprising in combination: said side walls each having two bores, said bores being horizontally aligned in pairs across an interior space of the shroud;

release pins means having two spaced apart, parallelly extending legs for insertion into said bores to establish a horizontal support plane in the space in between the side walls of the shroud;

joist support plate means disposed on said legs and being permitted to drop out of the shroud in down direction without requiring lifting, upon removal of said release pin means; and means for obtaining level changes in vertical direction between the angle element and the joist support plate means as disposed on said legs.

14. A joist hanger as in claim 13, wherein said joist support plate means include the first plate disposed on said legs, and a second support plate being included in the means for obtaining level changes, said means for obtaining level changes being a jack screw assembly having a threaded bolt, threadedly traversing said first plate and including said second plate, said second plate being journaled on top of said threaded bolt.

15. A joist hanger as in claim 13 and including a stand-off device including a pair of stand-off plates respectively conneted to the side walls of the shroud, further having a stand-off member secured to the stand-off plates and abutting with one end against said rear wall, the member provided for engaging the beam with an end of the member located opposite the one end.

16. A joist hanger as in claim 15, said stand-off plates being hinged to said sidewalls.

17. A joist hanger as in claim 15, the stand-off plates having bores registering with said bores in said sidewalls, said release pin means traversing also the bores of the stand-off plates to thereby connect the devise of the shroud.

18. A joist hanger as in claim 15, said sidewalls having downwardly inclined front edges, said stand-off plates being joined by a bottom and having arms with hook means engaging said rear edges as an edge of the bottom abutts said rear wall.

19. A joist hanger as in claim 13, said rear wall having a slot, the joist support plage being inserted in the slot.

20. A joist hanger as in claim 13, and including a wedge driven between a joist when on the support plate and the rear wall of the shroud.

21. A joist hanger for being dependent from a beam and having a shroud, the shroud being comprised of an integral structure of a rear wall and two parallel side walls, the hanger further having an L-shaped angle element connected to the rear wall of the shroud and adapted for depending the hanger from the beam, the improvement comprising, in combination:

joist support plate means disposed between said side walls and being relatively connected to the shroud to permit dropping out of the shroud and in down direction without requiring lifting;

a stand-off device including a stand-off support being connected to the side walls of the shroud and without obstructing any dropping out of the support plate means from between the side walls of the shroud, said stand-off support having side wall plates, portions of the side wall plates extending rearwardly from the side of the shroud, the stand-off device further having a stand-off member constructed for lateral shifting and sliding insertion and without threading between said side wall plate portions and in abutment therewith; and means for affixing the member to the side side wall plate portions of the stand-off support in a disposition in which one end of the member abuts against said rear wall of the shroud, said stand-off member having an end opposite to said one end of the member for engaging the beam.

22. A joist hanger as in claim 21, said stand-off support being hinged to said sidewalls.

23. A joist hanger as in claim 21, the stand-off support having bores registering with said bores in said sidewalls said release pin means traversing also the bores.

24. A joist hanger as in claim 21, said side wall plates of the stand-off support being joined by a bottom to establish a cradle for receiving the stand-off members.

25. A joist hanger as in claim 24, said side walls of the shroud having downwardly inclined front edges, said stand-off plates having arms with hook means engaging respectively said front edges as an edge of the cradle bottom abuts said rear wall.

* * * * *